US010530081B1

(12) United States Patent
Costello et al.

(10) Patent No.: US 10,530,081 B1
(45) Date of Patent: Jan. 7, 2020

(54) DUAL CONNECTOR ASSEMBLY FOR A CIRCUIT BOARD

(71) Applicant: TE CONNECTIVITY CORPORATION, Berwyn, PA (US)

(72) Inventors: Brian Patrick Costello, Scotts Valley, CA (US); William Charles McGee, III, Lincoln, CA (US)

(73) Assignee: TE CONNECTIVITY CORPORATION, Berwyn, PA (US)

( * ) Notice: Subject to any disclaimer, the term of this patent is extended or adjusted under 35 U.S.C. 154(b) by 0 days.

(21) Appl. No.: 16/267,909

(22) Filed: Feb. 5, 2019

(51) Int. Cl.
*H01R 12/00* (2006.01)
*H01R 12/72* (2011.01)
*H01R 12/58* (2011.01)

(52) U.S. Cl.
CPC ..... *H01R 12/724* (2013.01); *H01R 12/585* (2013.01); *H01R 12/727* (2013.01)

(58) Field of Classification Search
CPC ... H01R 12/724; H01R 12/585; H01R 12/727
USPC ..... 439/55, 78, 79
See application file for complete search history.

(56) References Cited

U.S. PATENT DOCUMENTS

| | | | | |
|---|---|---|---|---|
| 8,944,830 | B2 | 2/2015 | Little et al. | |
| 9,166,315 | B1 * | 10/2015 | Phillips | H01R 12/722 |
| 10,069,262 | B2 * | 9/2018 | Little | H01R 12/721 |
| 10,186,794 | B2 * | 1/2019 | Regnier | H01R 12/585 |
| 10,367,308 | B2 * | 7/2019 | Little | H01R 4/2404 |
| 10,396,513 | B2 * | 8/2019 | Regnier | H01R 12/721 |
| 2018/0277973 | A1 | 9/2018 | Regnier | |

* cited by examiner

*Primary Examiner* — Khiem M Nguyen

(57) ABSTRACT

A dual connector assembly includes first and second electrical connectors. The first electrical connector has a first housing holding a first contact. The first housing has a mating end mated with a first mating connector and a mounting end mounted to a circuit board. The first housing has a first mounting block including a first mounting surface. The second electrical connector has a second housing holding a second contact. The second housing has a mating end mated with a second mating connector and a mounting end coupled to the mounting end of the first housing. The second housing has a second mounting block facing the first mounting block such that the second mounting surface engages the first mounting surface to locate the second housing relative to the circuit board. The mounting end of the second housing is held spaced apart from the circuit board by the first electrical connector.

20 Claims, 6 Drawing Sheets

DUAL CONNECTOR ASSEMBLY FOR A CIRCUIT BOARD

BACKGROUND OF THE INVENTION

The subject matter herein relates generally to electrical connector systems.

Electrical connector systems are used to electrically connect various components with a circuit board. Some known electrical connector systems utilize press-fit connectors that are press-fit to the circuit board. Due to space constraints on the circuit board, it may be desirable in some electrical connector systems to provide a stacked electrical connector that provides two or more mating interfaces four mating with two or more components, such as plug connectors. In some known electrical connector systems, the stacked electrical connector is provided with both mating interfaces on one side of the circuit board. However, in other known electrical connector systems, it may be desirable to have the mating interfaces straddling the circuit board on opposite sides of the circuit board.

Conventional stacked electrical connectors that straddle the circuit board are bulky and may be difficult to assemble. Additionally, mating forces applied to the electrical connector during mating with the mating connector tend to rotate the connector relative to the circuit board. The mating forces may damage the electrical interface between the contacts and the circuit board. Other known electrical connector systems use a second circuit board oriented perpendicular to the main circuit board with a pair of electrical connectors mounted to the vertical circuit board. A third electrical connector is provided on the main circuit board that receives the vertical circuit board. Such electrical connector systems are expensive due to the multiple electrical connectors and additional circuit board as well as mounting hardware to support the vertical circuit board for mating and un-mating of the plug connectors.

BRIEF DESCRIPTION OF THE INVENTION

In one embodiment, a dual connector assembly is provided including a first electrical connector and a second electrical connector. The first electrical connector has a first housing holding a first contact. The first housing has a mating end configured to be mated with a first mating connector and a mounting end configured to be mounted to a circuit board. The first contact extends between the mating and mounting ends for electrical connection with the first mating connector and the circuit board. The first housing has a first mounting block including a first mounting surface. The second electrical connector has a second housing holding a second contact. The second housing has a mating end configured to be mated with a second mating connector and a mounting end being coupled to the mounting end of the first housing. The second contact extends between the mating and mounting ends for electrical connection with the second mating connector and the circuit board. The second housing has a second mounting block including a second mounting surface. The second mounting block faces the first mounting block at the mounting end such that the second mounting surface engages the first mounting surface to locate the second housing relative to the circuit board. The mounting end of the second housing is held spaced apart from the circuit board by the first electrical connector.

In another embodiment, a dual connector assembly is provided including a first electrical connector and a second electrical connector. The first electrical connector has a first housing holding a first contact. The first housing has a mating end and a mounting end. The mating end is configured to be mated with a first mating connector. The mounting end is configured to be mounted to a circuit board. The mounting end has a first circuit board pocket configured to receive the circuit board. The first contact extends between the mating and mounting ends for electrical connection with the first mating connector and the circuit board. The first housing has a first mounting block including a first mounting surface. The second electrical connector has a second housing holding a second contact. The second housing has a mating end and a mounting end. The mating end is configured to be mated with a second mating connector. The mounting end is coupled to the mating end of the first housing. The second contact extends between the mating and mounting ends for electrical connection with the second mating connector and the circuit board. The mounting end has a second circuit board pocket facing the first circuit board pocket to receive the circuit board. The second housing has a second mounting block including a second mounting surface. The second mounting block faces the first mounting block at the mounting end such that the second mounting surface engages the first mounting surface to locate the second housing relative to the circuit board. The mounting end of the second housing is held spaced apart from the circuit board by the first electrical connector.

In a further embodiment, an electrical connector system is provided including a circuit board having a first surface and a second surface with an edge extending therebetween. The circuit board has first conductors at the first surface and second conductors at the second surface. The circuit board has a locating opening open between the first and second surfaces. The electrical connector system includes a first electrical connector coupled to the circuit board. The first electrical connector has a first housing holding a first contact electrically connected to the first conductor. The first housing has a mating end and a mounting end. The mating end is configured to be mated with a first mating connector. The mounting end is mounted to the circuit board. The first contact extends between the mating and mounting ends for electrical connection with the first mating connector and the circuit board. The first housing has a first mounting block including a first mounting surface. The electrical connector system includes a second electrical connector coupled to the circuit board. The second electrical connector has a second housing holding a second contact electrically connected to the second conductor. The second housing has a mating end and a mounting end. The mating end is configured to be mated with a second mating connector. The mounting end is coupled to the mating end of the first housing. The second contact extends between the mating and mounting ends for electrical connection with the second mating connector and the circuit board. The second housing has a second mounting block including a second mounting surface. The second mounting block faces the first mounting block at the mounting end such that the second mounting surface engages the first mounting surface to locate the second housing relative to the circuit board. The mounting end of the second housing is held spaced apart from the circuit board by the first electrical connector.

DETAILED DESCRIPTION OF THE INVENTION

Figure 1:
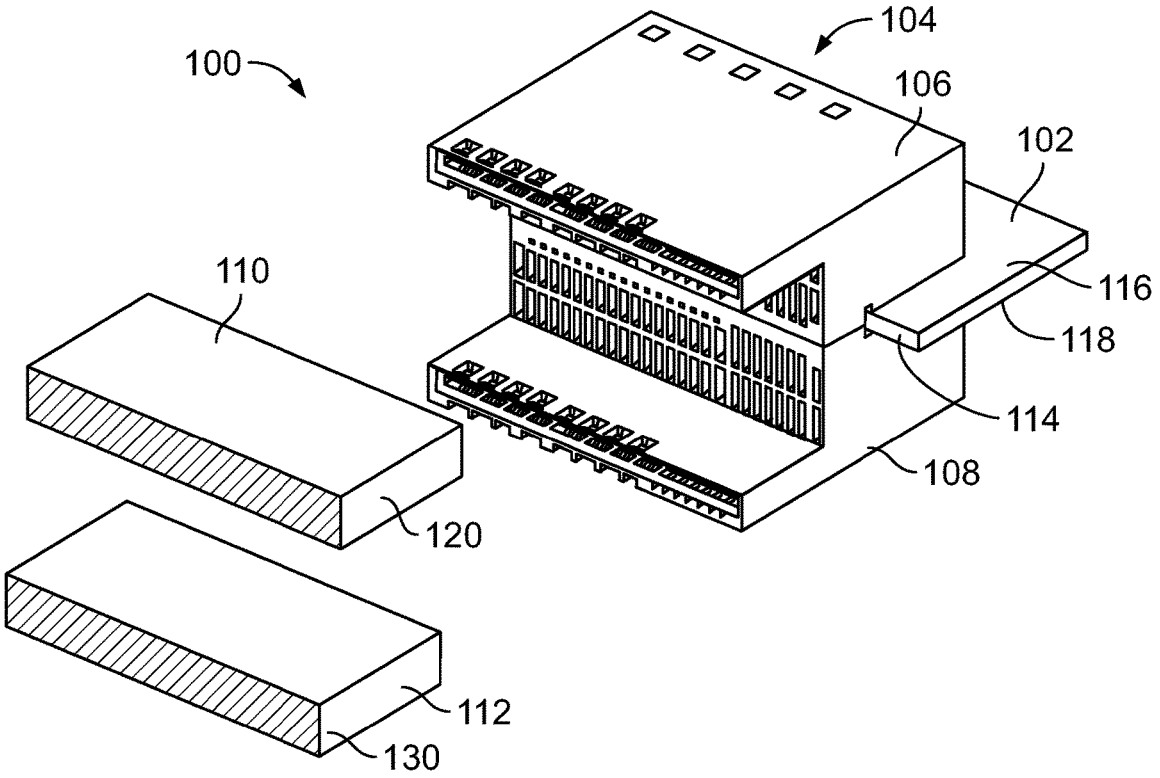
FIG. 1 is a front perspective view of an electrical connector system having a dual connector assembly in accordance with an exemplary embodiment.
Figure 2:
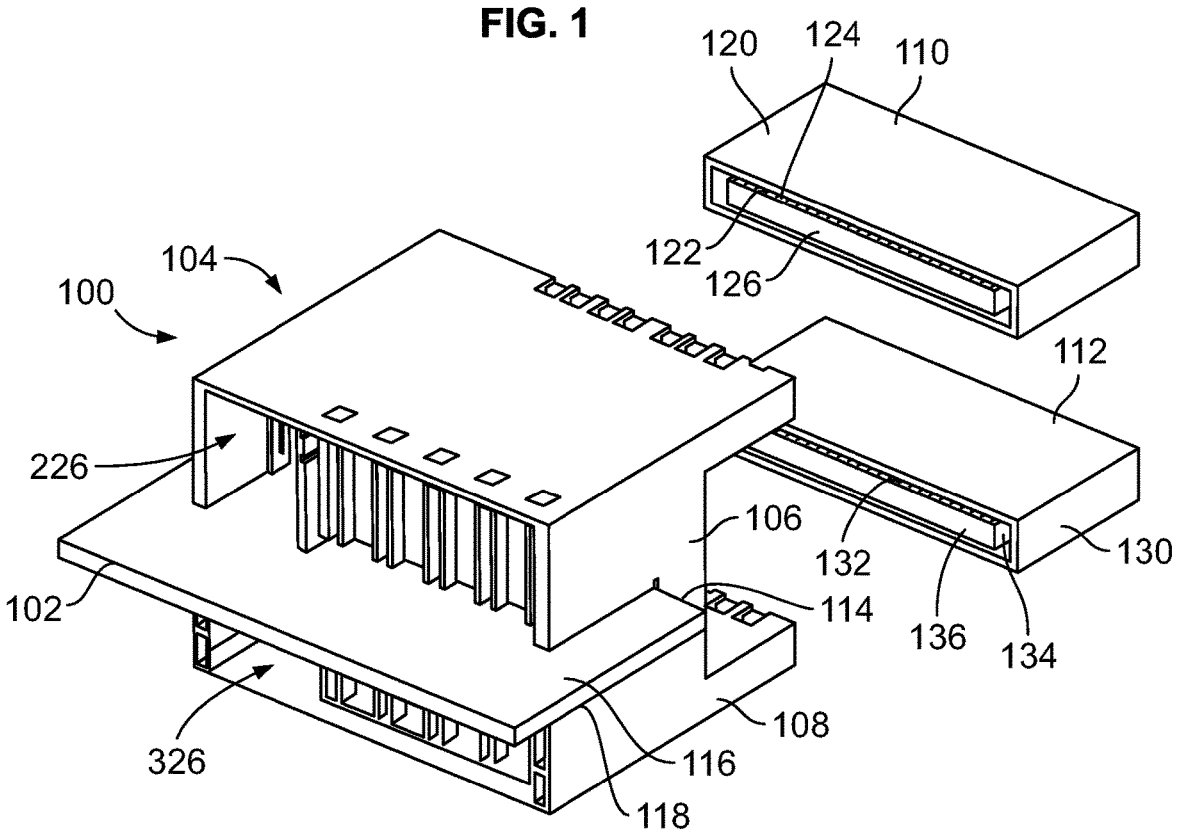
FIG. 2 is a rear perspective view of the electrical connector system in accordance with an exemplary embodiment.

FIG. 1 is a front perspective view of an electrical connector system 100 in accordance with an exemplary embodiment. FIG. 2 is a rear perspective view of the electrical connector system 100 in accordance with an exemplary embodiment. The electrical connector system 100 includes a circuit board 102 and a dual connector assembly 104 coupled to the circuit board 102. The dual connector assembly 104 includes a first electrical connector 106 and a second electrical connector 108 discrete from the first electrical connector 106. The first and second electrical connectors 106, 108 are separately coupled to the circuit board 102. A first mating connector 110 is configured to be coupled to the first electrical connector 106 and a second mating connector 112 is configured to be coupled to the second electrical connector 108.

In an exemplary embodiment, the dual connector assembly 104 is coupled to an edge 114 of the circuit board 102. The circuit board 102 includes a first surface 116 and a second surface 118 with the edge 114 extending therebetween. The first electrical connector 106 is coupled to the circuit board 102 at the first surface 116 and the second electrical connector 108 is coupled to the circuit board 102 at the second surface 118. In the illustrated embodiment, the first surface 116 is an upper surface and the first electrical connector 106 is located generally above the first surface 116. Optionally, a portion of the first electrical connector 106 extends forward of the edge 114. In the illustrated embodiment, the second surface 118 is a lower surface and the second electrical connector 108 is located generally below the second surface 118. Optionally, a portion of the second electrical connector 108 extends forward of the edge 114.

During assembly, the first electrical connector 106 may be initially coupled to the first surface 116 of the circuit board 102 and then the second electrical connector 108 may be coupled to the circuit board 102 until the second electrical connector 108 engages the first electrical connector 106. In an exemplary embodiment, the second electrical connector 108 is coupled to the first electrical connector 106 forward of the edge 114 of the circuit board 102. In an exemplary embodiment, the second electrical connector 108 is coupled to the first electrical connector 106 through the circuit board 102.

The first electrical connector 106 is used to locate the second electrical connector 108 relative to the circuit board 102. For example, the second electrical connector 108 engages the first electrical connector 106 to locate the second electrical connector 108 independent of the circuit board 102. In an exemplary embodiment, the second electrical connector 108 bottoms out against the first electrical connector 106 without bottoming out against the circuit board 102. As such, the mating interface of the second electrical connector 108 is located relative to the mating interface of the first electrical connector 106 by the first electrical connector 106 independent of the circuit board 102. The first electrical connector 106 may be manufactured with tighter tolerances than the circuit board 102 and as such, the second electrical connector 108 is more precisely positioned using the first electrical connector 106 as a datum rather than using the circuit board 102 as a datum. In an exemplary embodiment, the dual connector assembly 104 may be coupled to different circuit boards 102 having different thicknesses without changing the relative locations of the mating interfaces of the first and second electrical connectors 106, 108 because the second electrical connector 108 is located by the first electrical connector 106 rather than being located by the circuit board 102 (such as by the second surface 118).

In an exemplary embodiment, the first and second electrical connectors 106, 108 are power receptacle connectors. The power receptacle connectors include power contacts used to electrically connect the mating connectors 110, 112 and the circuit board 102. The power receptacle connectors include receptacles configured to receive portions of the mating connectors 110, 112. For example, the mating connectors 110, 112 may be plug connectors configured to be plugged into the power receptacle connectors. The first and second electrical connectors 106, 108 may be other types of connectors in alternative embodiments. In the illustrated embodiment, the first and second electrical connectors 106, 108 include signal contacts and power contacts. In alternative embodiments, the first second electrical connectors 106, 108 may include only power contacts. In other alternative embodiments, the first and second electrical connectors 106, 108 may include only signal contacts. In various embodiments, the first and second electrical connectors 106, 108 may include ground contacts.

The first mating connector 110 includes a housing 120 holding one or more mating contacts 122. In the illustrated embodiment, the housing 120 holds a circuit card 124 having the mating contacts 122. A card edge 126 of the circuit card 124 is configured to be plugged into the first electrical connector 106. In an exemplary embodiment, the mating contacts 122 are defined by circuit traces, pads, vias, and the like of the circuit card 124. Optionally, the mating contacts 122 may include power mating contacts, signal mating contacts, and/or ground mating contacts. The mating contacts 122 may be arranged on an upper surface of the circuit card 124 and/or a lower surface of the circuit card 124. In various embodiments, the first mating connector 110 may be an I/O connector, such as a transceiver module.

The second mating connector 112 includes a housing 130 holding one or more mating contacts 132. In the illustrated embodiment, the housing 130 holds a circuit card 134 having the mating contacts 132. A card edge 136 of the circuit card 134 is configured to be plugged into the second electrical connector 108. In an exemplary embodiment, the mating contacts 132 are defined by circuit traces, pads, vias, and the like of the circuit card 134. Optionally, the mating contacts 132 may include power mating contacts, signal mating contacts, and/or ground mating contacts. The mating contacts 132 may be arranged on an upper surface of the circuit card 134 and/or a lower surface of the circuit card 134. In various embodiments, the second mating connector 112 may be an I/O connector, such as a transceiver module. In other various embodiments, the second mating connector 112 may be integrated with the first mating connector 110 as a single mating connector configured to be mated with both the first and second electrical connectors 106, 108.

Figure 3:
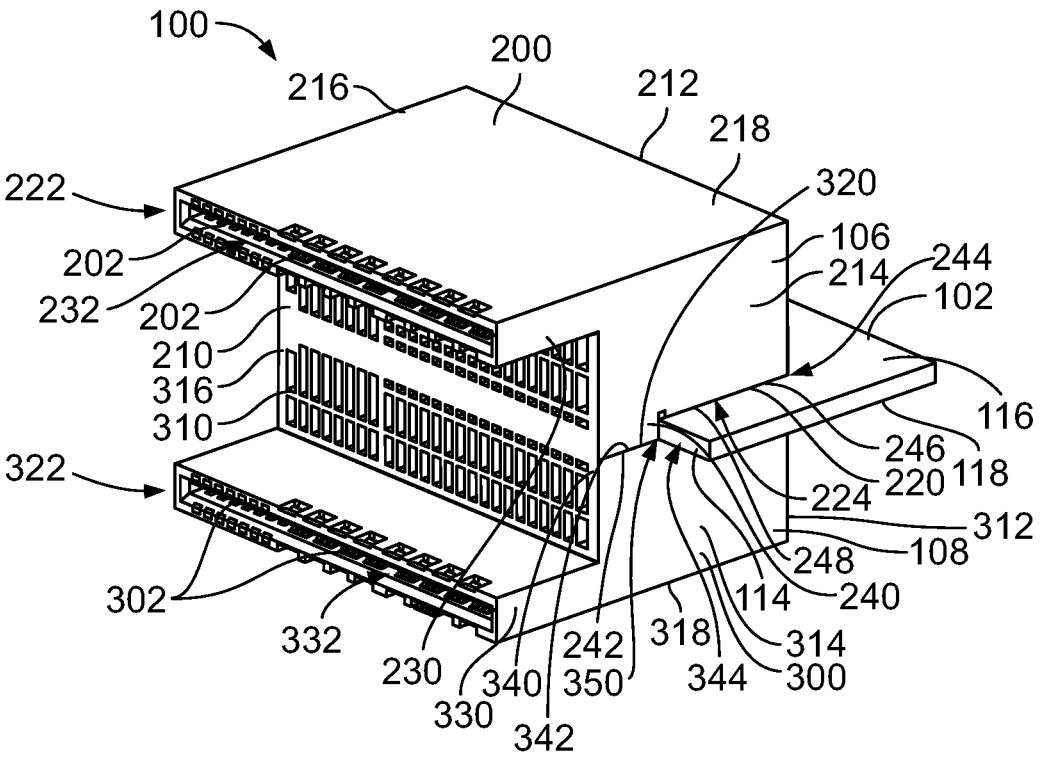
FIG. 3 is a top perspective view of the dual connector assembly of the electrical connector system in accordance with an exemplary embodiment.
Figure 4:
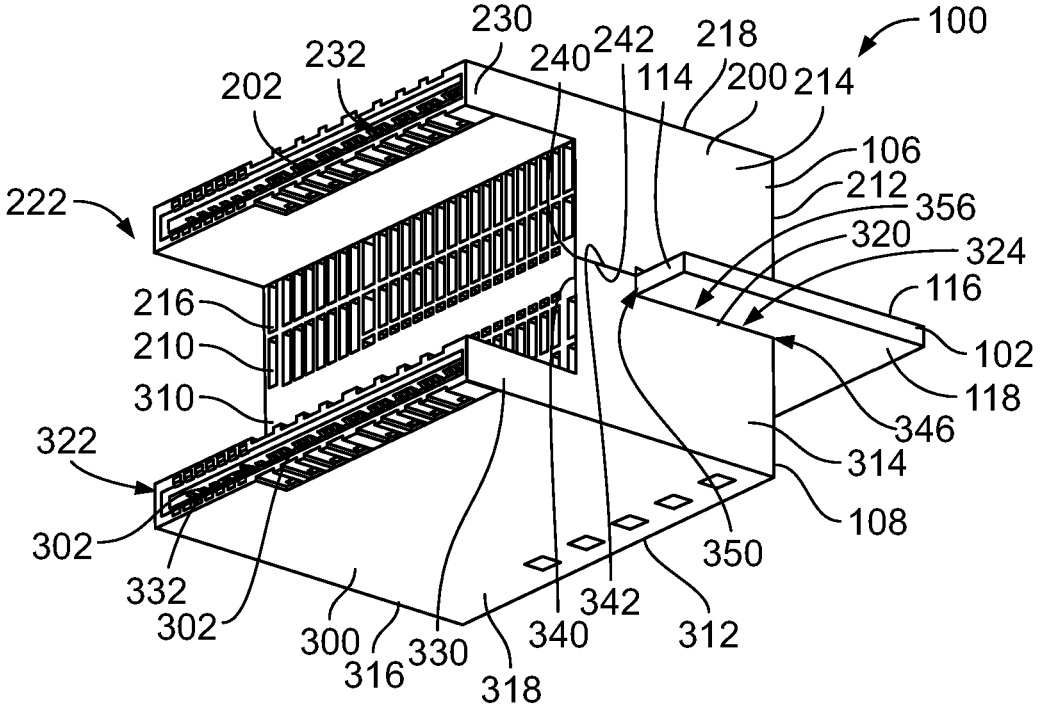
FIG. 4 is a bottom perspective view of the dual connector assembly of the electrical connector system in accordance with an exemplary embodiment.

FIG. 3 is a top perspective view of the electrical connector system 100 in accordance with an exemplary embodiment. FIG. 4 is a bottom perspective view of the electrical connector system 100 in accordance with an exemplary embodiment.

The first electrical connector 106 includes a housing 200 holding one or more contacts 202. The housing 200 has a front 210 and a rear 212. The housing 200 includes a first side 214 and a second side 216. The housing 200 extends between a first end 218 and a second end 220. In the illustrated embodiment, the first electrical connector 106 is oriented such that the first end 218 is a top and the second end 220 is a bottom; however, other orientations are possible in alternative embodiments. The housing 200 extends between a mating end 222 and a mounting end 224. In the illustrated embodiment, the mounting end 224 is provided at the second end 220, such as at the bottom. In the illustrated embodiment, the mating end 222 is provided at the front 210. In an exemplary embodiment, the housing 200 includes a cavity 226 (shown in FIG. 2) that receives the contacts 202. The cavity 226 may be open at the rear 212 to receive the contacts 202.

In an exemplary embodiment, the housing 200 includes an extension 230 at the front 210. The extension 230 includes a card slot 232 configured to receive the circuit card 124 (shown in FIG. 2) of the first mating connector 110 (shown in FIG. 2). The contacts 202 are arranged in the card slot 232 for mating with the circuit card 124. In an exemplary embodiment, the contacts 202 are arranged in an upper row and a lower row above and below the card slot 232 for mating with both sides of the circuit card 124. Other orientations of the contacts 202 are possible in alternative embodiments.

In an exemplary embodiment, the housing 200 includes a mounting block 240 having a mounting surface 242. The second electrical connector 108 is coupled to the housing 200 at the mounting block 240. For example, the second electrical connector 108 engages the mounting surface 242 to locate the second electrical connector 108 relative to the first electrical connector 106. The mounting block 240 is located at the second end 220 and at the front 210. A circuit board pocket 244 is located rearward of the mounting block 240. The circuit board pocket 244 receives the circuit board 102. The mounting block 240 is configured to be located forward of the edge 114 of the circuit board 102. In an exemplary embodiment, the housing 200 includes a base wall 246 along the second end 220 rearward of the mounting block 240. The base wall 246 defines the circuit board pocket 244. The base wall 246 faces the circuit board 102. In an exemplary embodiment, the base wall 246 engages the first surface 116 of the circuit board 102. The first electrical connector 106 is mounted to the circuit board 102 until the base wall 246 is seated on the first surface 116. The engagement of the base wall 246 with the first surface 116 locates the first electrical connector 106 relative to the circuit board 102. The base wall 246 is a datum surface 248 of the first electrical connector 106.

The second electrical connector 108 includes a housing 300 holding one or more contacts 302. The housing 300 has a front 310 and a rear 312. The housing 300 includes a first side 314 and a second side 316. The housing 300 extends between a first end 318 and a second end 320. In the illustrated embodiment, the second electrical connector 108 is oriented such that the first end 318 is a bottom and the second end 320 is a top; however, other orientations are possible in alternative embodiments. The housing 300 extends between a mating end 322 and a mounting end 324, shown in FIG. 4. In the illustrated embodiment, the mounting end 324 is provided at the second end 320, such as at the top. In the illustrated embodiment, the mating end 322 is provided at the front 310. In an exemplary embodiment, the housing 300 includes a cavity 326 (shown in FIG. 2) that receives the contacts 302. The cavity 326 may be open at the rear 312 to receive the contacts 302.

In an exemplary embodiment, the housing 300 includes an extension 330 at the front 310. The extension 330 includes a card slot 332 configured to receive the circuit card 134 (shown in FIG. 2) of the second mating connector 112 (shown in FIG. 2). The contacts 302 are arranged in the card slot 332 for mating with the circuit card 134. In an exemplary embodiment, the contacts 302 are arranged in an upper row and a lower row above and below the card slot 332 for mating with both sides of the circuit card 134. Other orientations of the contacts 302 are possible in alternative embodiments.

In an exemplary embodiment, the housing 300 includes a mounting block 340 having a mounting surface 342. The mounting block 340 of the second electrical connector 108 is coupled to the mounting block 240 of the first electrical connector 106 to locate the second electrical connector 108 relative to the first electrical connector 106. For example, the mounting surface 342 engages the mounting surface 242 to locate the second electrical connector 108 relative to the first electrical connector 106. The mounting block 340 is located at the second end 320 and at the front 310. The mounting block 340 is configured to be located forward of the edge 114 of the circuit board 102.

A circuit board pocket 344 is located rearward of the mounting block 340. The circuit board pocket 344 receives the circuit board 102. The circuit board pocket 344 is aligned with the circuit board pocket 244 to form a circuit board channel 350 that receives the circuit board 102. In an exemplary embodiment, the housing 300 includes a base wall 346 along the second end 320 rearward of the mounting block 340. The base wall 346 defines the circuit board pocket 344. The base wall 346 faces the circuit board 102.

In an exemplary embodiment, the base wall 346 is configured to be spaced apart from the second surface 118 of the circuit board 102 when the second electrical connector 108 is coupled to the first electrical connector 106. For example, the mounting surface 242 positions the second electrical connector 108 such that the base wall 346 is spaced apart from the second surface 118 of the circuit board 102. A gap 356 is formed between the base wall 346 and the second surface 118. The width of the gap 356 is dependent on a width of the circuit board channel 350 and a thickness of the circuit board 102. In an exemplary embodiment, the width of the circuit board channel 350 is wide enough to accommodate different thicknesses of different circuit boards 102. For example, the circuit board channel 350 may accommodate 2.5 mm thick circuit boards and 3.5 mm thick circuit boards without changing the spacing between the mating interfaces of the first and second electrical connectors 106, 108. For example, because the second electrical connector 108 is located by the engagement with the first electrical connector 106 independent of the circuit board 102, different thickness circuit boards 102 may be accommodated. Having the oversized circuit board channel 350 accommodates manufacturing tolerances of the circuit boards 102 without affecting spacing of the mating interfaces of the first and second electrical connectors 106, 108.

Figure 5:
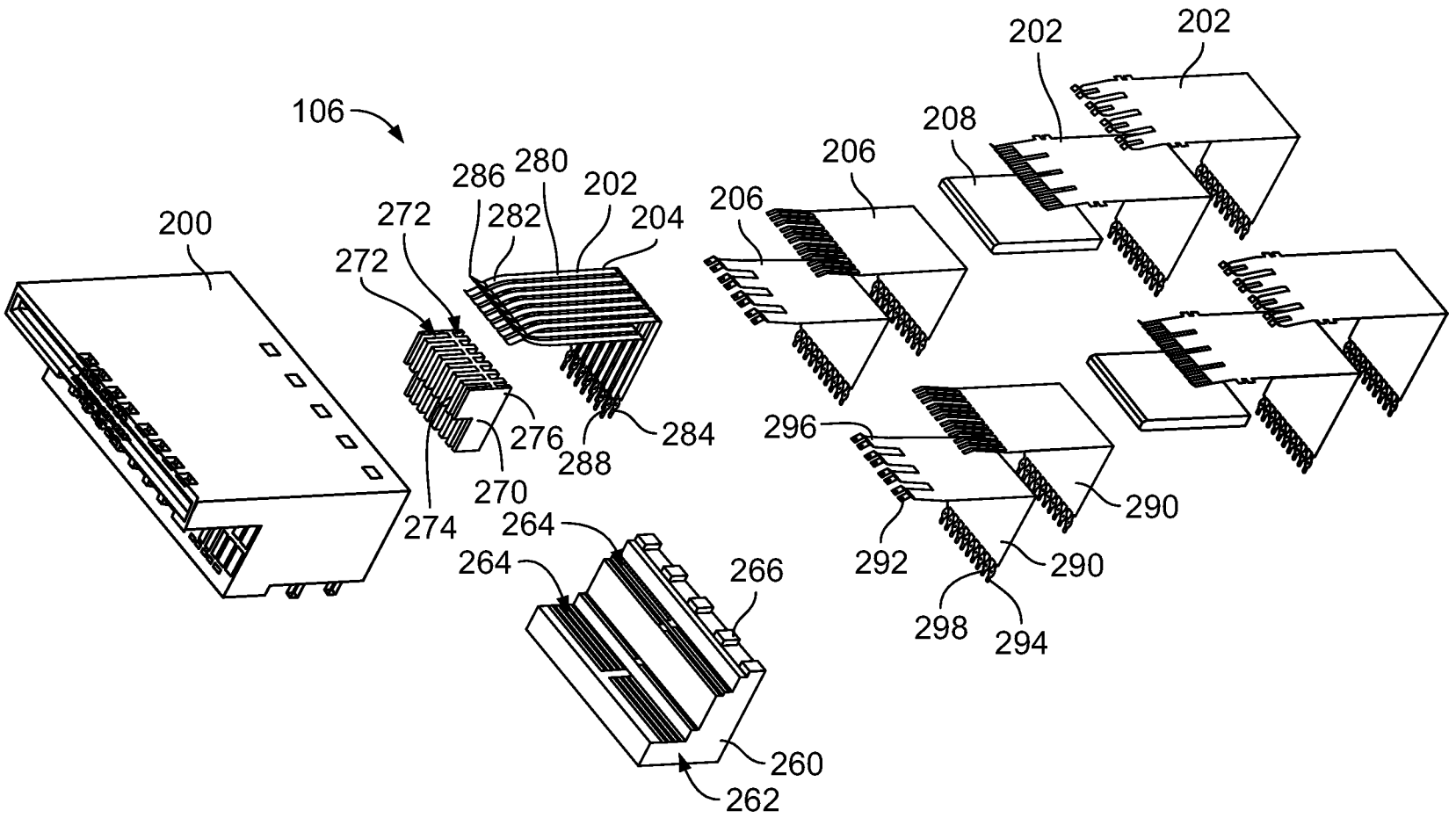
FIG. 5 is an exploded view of a first electrical connector of the dual connector assembly in accordance with an exemplary embodiment.

FIG. 5 is an exploded view of the first electrical connector 106 in accordance with an exemplary embodiment. The first electrical connector 106 includes the housing 200 and the contacts 202. In the illustrated embodiment, the contacts 202 include signal contacts 204 and power contacts 206. The first electrical connector 106 includes a contact holder 260 configured to hold the power contacts 206 and/or the signal contacts 204. Optionally, multiple contact holders 260 may be provided. The first electrical connector 106 includes a contact spacer 270 used to organize the signal contacts 204.

The contact holder 260 includes a mounting end 262 configured to face and/or mount to the circuit board 102 (shown in FIG. 1). The contact holder 260 includes contact channels 264 that receive the power contacts 206 and the signal contacts 204. The contact holder 260 may position the ends of the signal contacts 204 and the power contacts 206 relative to each other for mounting to the circuit board 102. In an exemplary embodiment, the contact holder 260 includes securing features 266 for securing the contact holder 260 to the housing 200. For example, the securing features 266 may be posts, tabs, latches, openings, or other types of securing features that interface with the housing 200 to hold the relative position of the contact holder 260 and the housing 200. In an exemplary embodiment, the contact holder 260 is manufactured from a dielectric material, such as a plastic material.

The contact spacer 270 includes contact channels 272 that receive individual signal contacts 204. The contact channels 272 may be provided along a front 274 and a rear 276 of the contact spacer 270 to receive different sets of signal contacts 204. The signal contacts 204 may be snapped into the contact channels 272 and held therein by latches or other types of securing features. In an alternative embodiment, the contact spacer 270 may be overmolded over the signal contacts 204. In an exemplary embodiment, the contact spacer 270 is manufactured from a dielectric material, such as a plastic material.

In an exemplary embodiment, each signal contact 204 includes a main body 280 extending between a mating end 282 and a terminating end 284. Optionally, the main body 280 may have one or more bends to shape the signal contact 204 between the mating end 282 and the terminating end 284. For example, the main body 280 may have a 90° or right angle bend. In the illustrated embodiment, the mating end 282 includes a spring beam 286 having a mating interface configured to mate with the corresponding mating contact 122 of the circuit card 124 (shown in FIG. 2). In the illustrated embodiment, the terminating end 284 includes a compliant pin 288, such as a press-fit pin, configured to be terminated to the circuit board 102. For example, the compliant pin 288 may be press-fit into a plated via of the circuit board 102. Other types of terminating ends may be provided in alternative embodiments, such as solder tails.

In an exemplary embodiment, each power contact 206 includes a main body 290 extending between a mating end 292 and a terminating end 294. Optionally, the main body 290 may have one or more bends to shape the power contact 206 between the mating end 292 and the terminating end 294. For example, the main body 290 may have a 90° or right angle bend. In the illustrated embodiment, the mating end 292 includes spring beams 296 having mating interfaces configured to mate with the corresponding mating contact 122 of the circuit card 124. In the illustrated embodiment, the terminating end 294 includes compliant pins 298, such as press fit pins, configured to be terminated to the circuit board 102. For example, the compliant pins 298 may be press-fit into plated vias of the circuit board 102. Other types of terminating ends may be provided in alternative embodiments, such as solder tails.

In an exemplary embodiment, multiple power contacts 206 are provided to increase the current carrying capacity of the first electrical connector 106. The power contacts 206 may include anode power contacts and the cathode power contacts. In an exemplary embodiment, spacers 208 are provided and configured to be positioned between corresponding power contacts 206. The spacers 208 are manufactured from a dielectric material, such as a plastic material.

Figure 6:
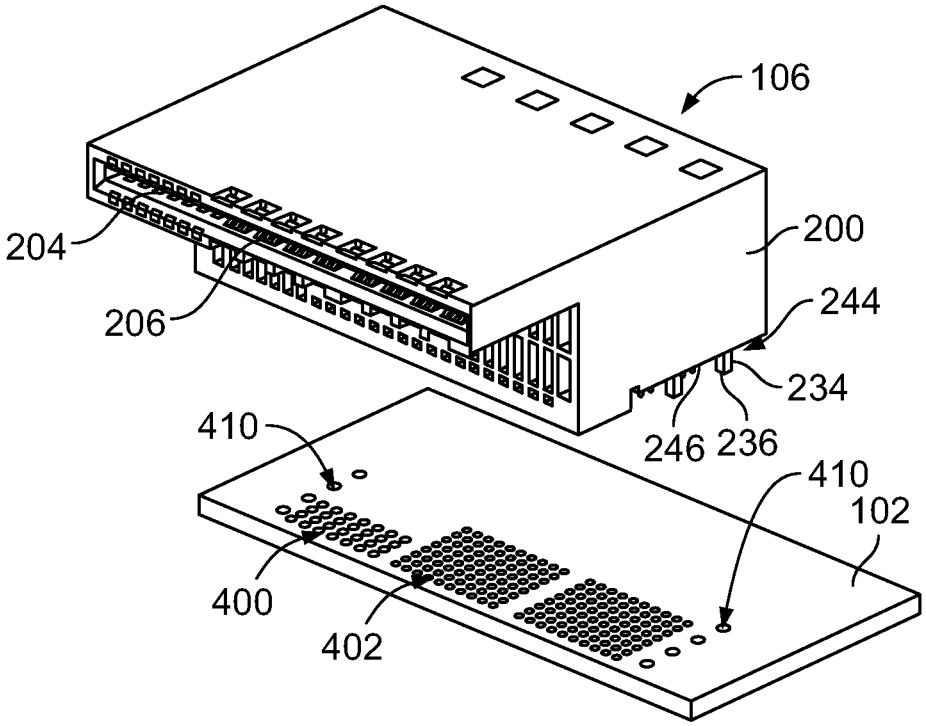
FIG. 6 is a front perspective view of the first electrical connector poised for mounting to a circuit board.

FIG. 6 is a front perspective view of the first electrical connector 106 poised for mounting to the circuit board 102. In an exemplary embodiment, the housing 200 includes one or more locating posts 234 extending from the base wall 246. The locating posts 234 extend into the circuit board pocket 244. The locating posts 234 may be cylindrical. However, the locating posts 234 may have other shapes in alternative embodiments, such as an oblong or oval shape. The locating posts 234 have locating surfaces 236 at distal ends thereof. The locating surfaces 236 are configured to engage the second electrical connector 108 (shown in FIG. 1) to locate the second electrical connector 108 relative to the first electrical connector 106. The locating surfaces 236 may define datum surfaces of the first electrical connector 106.

The circuit board 102 includes a plurality of plated vias extending therethrough. In the illustrated embodiment, the circuit board 102 includes signal vias 400 and power vias 402. The signal vias 400 are connected to corresponding signal traces within the circuit board 102. The power vias 402 are electrically connected to corresponding power circuits of the circuit board 102.

In an exemplary embodiment, the circuit board 102 includes openings 410 extending through the circuit board 102. The openings 410 receive corresponding locating posts 234 of the first electrical connector 106. The locating posts 234 may locate the first electrical connector 106 relative to the circuit board 102, such as to align the signal contacts 204 and the power contacts 206 with the corresponding signal vias 400 and power vias 402.

Figure 7:
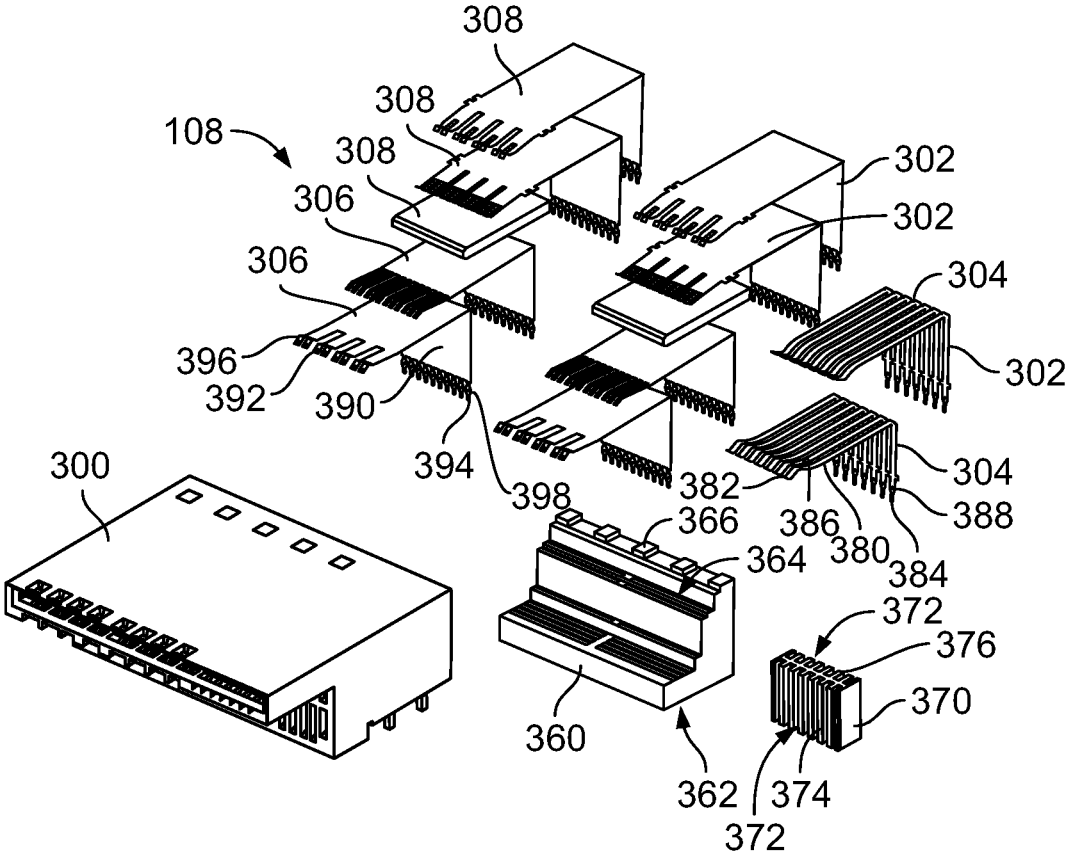
FIG. 7 is an exploded view of a second electrical connector of the dual connector assembly in accordance with an exemplary embodiment.

FIG. 7 is an exploded view of the second electrical connector 108 in accordance with an exemplary embodiment. The second electrical connector 108 includes the housing 300 and the contacts 302. In the illustrated embodiment, the contacts 302 include signal contacts 304 and power contacts 306. The second electrical connector 108 includes a contact holder 360 configured to hold the power contacts 306 and/or the signal contacts 304. Optionally, multiple contact holders 360 may be provided. The second electrical connector 108 includes a contact spacer 370 used to organize the signal contacts 304.

The contact holder 360 includes a mounting end 362 configured to face the circuit board 102 (shown in FIG. 1). The contact holder 360 includes contact channels 364 that receive the power contacts 306 and the signal contacts 304.

The contact holder 360 may position the ends of the signal contacts 304 and the power contacts 306 relative to each other for mounting to the circuit board 102. In an exemplary embodiment, the contact holder 360 includes securing features 366 for securing the contact holder 360 to the housing 300. For example, the securing features 366 may be posts, tabs, latches, openings, or other types of securing features that interface with the housing 300 to hold the relative position of the contact holder 360 and the housing 300. In an exemplary embodiment, the contact holder 360 is manufactured from a dielectric material, such as a plastic material.

The contact spacer 370 includes contact channels 372 that receive individual signal contacts 304. The contact channels 372 may be provided along a front 374 and a rear 376 of the contact spacer 370 to receive different sets of signal contacts 304. The signal contacts 304 may be snapped into the contact channels 372 and held therein by latches or other types of securing features. In an alternative embodiment, the contact spacer 370 may be overmolded over the signal contacts 304. In an exemplary embodiment, the contact spacer 370 is manufactured from a dielectric material, such as a plastic material.

In an exemplary embodiment, each signal contact 304 includes a main body 380 extending between a mating end 382 and a terminating end 384. Optionally, the main body 380 may have one or more bends to shape the signal contact 304 between the mating end 382 and the terminating end 384. For example, the main body 380 may have a 90° or right angle bend. In the illustrated embodiment, the mating end 382 includes a spring beam 386 having a mating interface configured to mate with the corresponding mating contact 122 of the circuit card 124 (shown in FIG. 3). In the illustrated embodiment, the terminating end 384 includes a compliant pin 388, such as a press-fit pin, configured to be terminated to the circuit board 102. For example, the compliant pin 388 may be press-fit into a plated via of the circuit board 102. Other types of terminating ends may be provided in alternative embodiments, such as solder tails.

In an exemplary embodiment, each power contact 306 includes a main body 390 extending between a mating end 392 and a terminating end 394. Optionally, the main body 390 may have one or more bends to shape the power contact 306 between the mating end 392 and the terminating end 394. For example, the main body 390 may have a 90° or right angle bend. In the illustrated embodiment, the mating end 392 includes spring beams 396 having mating interfaces configured to mate with the corresponding mating contact 122 of the circuit card 124. In the illustrated embodiment, the terminating end 394 includes compliant pins 398, such as press fit pins, configured to be terminated to the circuit board 102. For example, the compliant pins 398 may be press-fit into plated vias of the circuit board 102. Other types of terminating ends may be provided in alternative embodiments, such as solder tails.

In an exemplary embodiment, multiple power contacts 306 are provided to increase the current carrying capacity of the second electrical connector 108. The power contacts 306 may include anode power contacts and the cathode power contacts. In an exemplary embodiment, spacers 308 are provided and configured to be positioned between corresponding power contacts 306. The spacers 308 are manufactured from a dielectric material, such as a plastic material.

Figure 8:
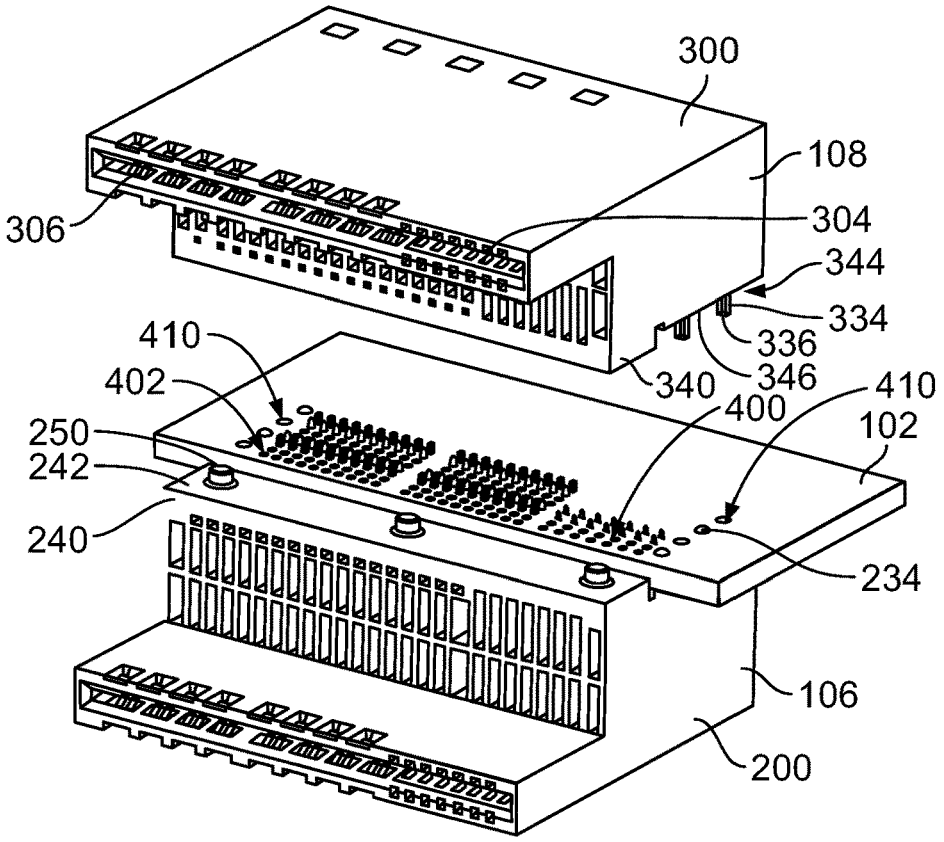
FIG. 8 is a front perspective view of the second electrical connector poised for mounting to the first electrical connector and the circuit board.

FIG. 8 is a front perspective view of the second electrical connector 108 poised for mounting to the first electrical connector 106 and the circuit board 102. In an exemplary embodiment, the housing 300 includes one or more locating posts 334 extending from the base wall 346. The locating posts 334 extend into the circuit board pocket 344 and are configured to be received in corresponding openings 410 in the circuit board 102. The locating posts 334 may be cylindrical. However, the locating posts 334 may have other shapes in alternative embodiments, such as an oblong or oval shape. The locating posts 334 have locating surfaces 336 at distal ends thereof. The locating surfaces 336 are configured to engage the first electrical connector 106, such as the base wall 246 of the housing 200, to locate the second electrical connector 108 relative to the first electrical connector 106. The locating surfaces 336 may define datum surfaces of the second electrical connector 108.

The base wall 346 is configured to engage the locating posts 234 of the first electrical connector 106 when coupled to the first electrical connector 106. The locating posts 234 extend through the openings 410 in the circuit board 102 and protrude beyond the second surface 118. The locating posts 234 holds the base wall 346 at a spaced apart location from the second surface 118.

In an exemplary embodiment, the mounting block 240 of the housing 200 includes mounting features 250 for mounting the second electrical connector 108 to the first electrical connector 106. The mounting features 250 extend from the mounting surface 242. In the illustrated embodiment, the mounting features 250 are mounting posts; however, other types of mounting features may be provided in alternative embodiments. The mounting features 250 may include openings receiving mounting posts of the second electrical connector 108. In an exemplary embodiment, the second electrical connector 108 includes openings that receive the mounting features 250. Optionally, the mounting features 250 may be press-fit into the mounting block 340 to secure the second electrical connector 108 to the first electrical connector 106. The mounting features 250 may include crush ribs. In an exemplary embodiment, the mounting features 250 are oblong, such as oval-shaped to prevent twisting or rotation of the second electrical connector 108 relative to the first electrical connector 106. The mounting features 250 may have other shapes in alternative embodiments.

During assembly, the second electrical connector 108 is coupled to the first electrical connector 106 and the circuit board 102. The signal contacts 304 and the power contacts 306 are electrically connected to the circuit board 102. For example, the terminating ends 384, 394 (shown in FIG. 7) are received in corresponding signal vias 400 and power vias 402.

Figure 9:
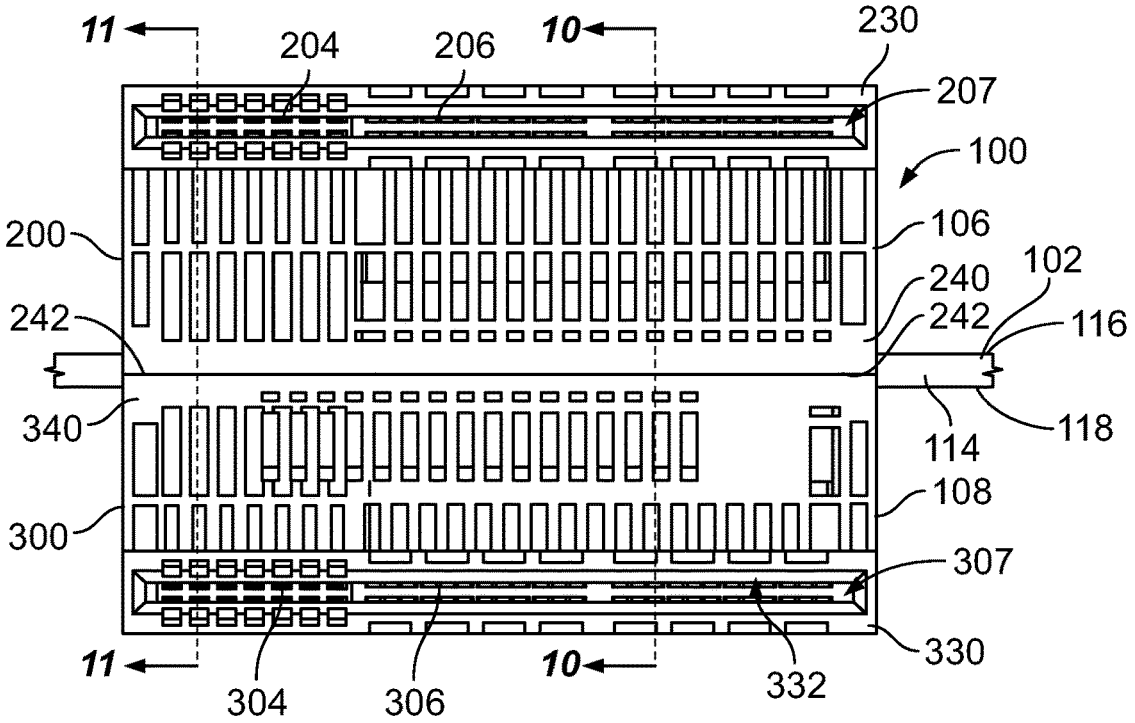
FIG. 9 is a front view of the dual connector assembly of the electrical connector system in accordance with an exemplary embodiment.

FIG. 9 is a front view of the electrical connector system 100 in accordance with an exemplary embodiment. The mounting block 340 is coupled to the mounting block 240. In the illustrated embodiment, both mounting blocks 240, 340 are located forward of the front edge 114 of the circuit board 102. An interface 252 between the mounting surfaces 242, 342 is aligned with the circuit board 102. However, in alternative embodiments, the interface 252 may be located at or above the first surface 116 or at or below the second surface 118. For example, the mounting blocks 240, 340 may have different lengths than illustrated in FIG. 8. In various embodiments, one of the mounting blocks 240, 340 may be coplanar with the corresponding base wall 246, 346. In other various embodiments, the mounting blocks may be recessed relative to the base wall 246 or 346 forming a pocket that receives the other mounting block 240, 340.

The first electrical connector 106 includes a mating interface 207 defined by the extension 230, the card slot 232 and the signal and power contacts 204, 206. The second electrical connector 108 includes a mating interface 307 defined by the extension 330, the card slot 332 and the signal and power contacts 304, 306. During assembly, the first electrical connector 106 is mounted to the first surface 116 of the circuit board 102. The first surface 116 of the circuit board 102 defines a datum surface for locating the first mating interface 207 relative to the first surface 116. During assembly, the second electrical connector 108 is mounted to the first electrical connector 106. The mounting surface 342 engages the mounting surface 242 at the interface 252. The mounting surface 242 forms a datum surface for the second electrical connector 108. The second mating interface 307 is located by the engagement of the mounting surface 342 with the mounting surface 242. As such, the second mating interface 307 is located relative to the first mating interface 207 by the engagement of the housing 300 with the housing 200 independent of the circuit board 102. The second electrical connector 108 does not bottom out against the circuit board 102, but rather bottoms out against the mounting block 240 to locate the second mating interface 307 relative to the first mating interface 207.

Figure 10:
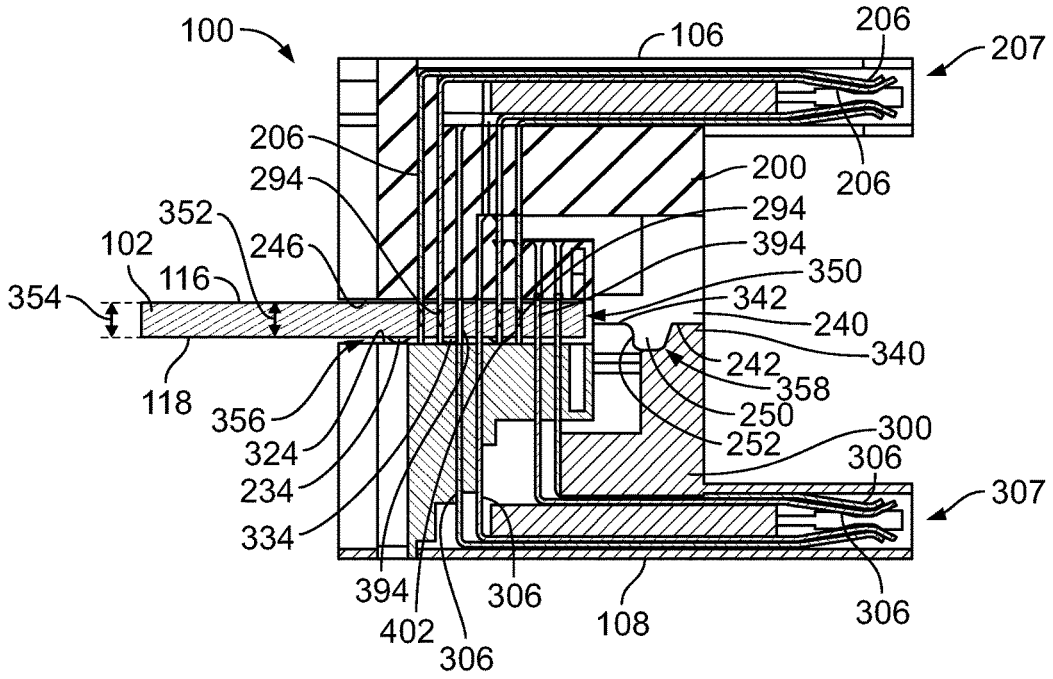
FIG. 10 is a cross-sectional view of the electrical connector system taken along line 10-10 shown in FIG. 9.
Figure 11:
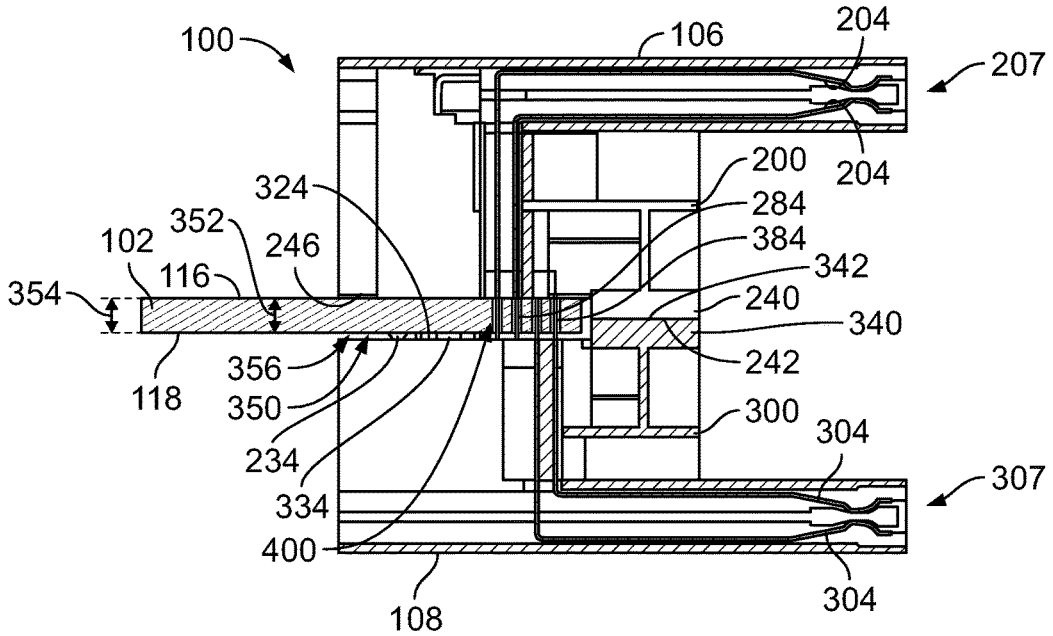
FIG. 11 is a cross-sectional view of the electrical connector system taken along line 11-11 shown in FIG. 9.

FIG. 10 is a cross-sectional view of the electrical connector system 100 taken along line 10-10 shown in FIG. 9. FIG. 11 is a cross-sectional view of the electrical connector system 100 taken along line 11-11 shown in FIG. 9. During assembly, the second electrical connector 108 is coupled to the first electrical connector 106 such that the gap 356 is formed between the mounting end 324 and the second surface 118 of the circuit board 102. The circuit board channel 350 is oversized relative to the circuit board 102 to ensure that the second electrical connector 108 does not bottom out against the circuit board 102 when the second electrical connector 108 is coupled to the first electrical connector 106. The circuit board channel 350 has a width 352 between the base wall 346 and the base wall 246. The width 352 is wider than a thickness 354 of the circuit board 102. As such, the circuit board 102 does not interfere with coupling the mounting surface 342 to the mounting surface 242 to locate the second electrical connector 108 relative to the first electrical connector 106.

During assembly, the first electrical connector 106 is initially coupled to the circuit board 102. The housing 200 abuts against and engages the first surface 116 of the circuit board 102. The first electrical connector 106 is pressed onto the circuit board 102 until the base wall 246 is seated on the first surface 116. The terminating ends 284, 294 of the signal contacts 204 and the power contacts 206 are received in corresponding vias 400, 402. The locating posts 234 extend through the circuit board 102 and protrude beyond the second surface 118.

During assembly, the second electrical connector 108 is coupled to the first electrical connector 106 and the circuit board 102. The terminating ends 384, 394 of the signal contacts 304 and the power contacts 306 are received in corresponding vias 400, 402. The locating posts 334 extend through the circuit board 102 to engage the first electrical connector 106. During assembly, the second housing 300 is coupled to the first housing 200 at the mounting blocks 240, 340. The mounting surfaces 242, 342 engage each other at the interface 252. The mounting features 250 are secured to corresponding mounting features 358 (shown in FIG. 10). The second mating interface 307 is located relative to the first mating interface 207 by the mounting blocks 240, 340 and the locating posts 234, 334 independent of the circuit board 102. The second housing 300 is not coupled to the second surface 118 of the circuit board 102, but rather is spaced apart from the second surface 118 to form the gap 356.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. § 112(f), unless and until such claim limitations expressly use the phrase "means for" followed by a statement of function void of further structure.

What is claimed is:

1. A dual connector assembly comprising:

a first electrical connector having a first housing holding a first contact, the first housing having a mating end and a mounting end, the mating end configured to be mated with a first mating connector, the mounting end configured to be mounted to a circuit board, the first contact extending between the mating and mounting ends for electrical connection with the first mating connector and the circuit board, the first housing having a first mounting block including a first mounting surface; and a second electrical connector having a second housing holding a second contact, the second housing having a mating end and a mounting end, the mating end configured to be mated with a second mating connector, the mounting end being coupled to the mounting end of the first housing, the second contact extending between the mating and mounting ends for electrical connection with the second mating connector and the circuit board, the second housing having a second mounting block including a second mounting surface, the second mounting block facing the first mounting block at the mounting end such that the second mounting surface engages the first mounting surface to locate the second housing relative to the circuit board, the mounting end of the second housing being held spaced apart from the circuit board by the first electrical connector.

2. The dual connector assembly of claim 1, wherein the first mounting surface defines a datum surface for locating the second electrical connector relative to the first electrical connector independent of the circuit board.

3. The dual connector assembly of claim 1, wherein the mounting end of the second housing is positioned by the first electrical connector spaced apart from the circuit board.

4. The dual connector assembly of claim 1, wherein a gap is defined between the mounting end of the second housing and the circuit board.

5. The dual connector assembly of claim 1, wherein the mounting end of the first electrical connector faces a first surface of the circuit board and the mounting end of the second electrical connector faces a second surface of the circuit board opposite the first surface.

6. The dual connector assembly of claim 1, wherein at least one of the first mounting block and the second mounting block is positioned forward of an edge of the circuit board.

7. The dual connector assembly of claim 1, wherein the first electrical connector is coupled to the circuit board independent of the second electrical connector being coupled to the circuit board.

8. The dual connector assembly of claim 1, wherein the first mounting surface is a bottom surface of the first housing and the second mounting surface is a top surface of the second housing directly engaging the first housing.

9. The dual connector assembly of claim 1, wherein the first housing includes a first locating post extending through the circuit board, the first locating post having a first locating surface engaging the second housing to position the second housing relative to the first housing independent of the circuit board.

10. The dual connector assembly of claim 1, wherein the second housing includes a second locating post extending through the circuit board, the second locating post having a second locating surface engaging the first housing to position the second housing relative to the first housing independent of the circuit board.

11. The dual connector assembly of claim 1, wherein the first housing includes a first circuit board pocket at the mounting end configured to receive the circuit board, the first contacts extending into the first circuit board pocket to electrically connect to the circuit board, the second housing having a second circuit board pocket at the mounting end configured to receive the circuit board, the second contacts extending into the second circuit board pocket to electrically connect to the circuit board.

12. The dual connector assembly of claim 1, wherein a circuit board channel is defined between the mounting end of the first housing and the mounting end of the second housing, the circuit board channel receiving the circuit board between the mounting end of the first housing and the mounting end of the second housing.

13. The dual connector assembly of claim 12, wherein the circuit board channel is oversized relative to the circuit board such that the mounting end of the first housing engages the circuit board and a gap is defined between the mounting end of the second housing and the circuit board.

14. The dual connector assembly of claim 1, wherein the first housing includes a card slot at the mating end configured to receive a circuit card of the first mating connector and the second housing includes a card slot at the mating end configured to receive a circuit card of the second mating connector.

15. The dual connector assembly of claim 1, wherein the first contact is a first power contact and the second contact is a second power contact.

16. A dual connector assembly comprising:

a first electrical connector having a first housing holding a first contact, the first housing having a mating end and a mounting end, the mating end configured to be mated with a first mating connector, the mounting end configured to be mounted to a circuit board, the mounting end having a first circuit board pocket configured to receive the circuit board, the first contact extending between the mating and mounting ends for electrical connection with the first mating connector and the circuit board, the first housing having a first mounting block including a first mounting surface; and a second electrical connector having a second housing holding a second contact, the second housing having a mating end and a mounting end, the mating end configured to be mated with a second mating connector, the mounting end being coupled to the mounting end of the first housing, the second contact extending between the mating and mounting ends for electrical connection with the second mating connector and the circuit board, the mounting end having a second circuit board pocket facing the first circuit board pocket to receive the circuit board, the second housing having a second mounting block including a second mounting surface, the second mounting block facing the first mounting block at the mounting end such that the second mounting surface engages the first mounting surface to locate the second housing relative to the circuit board, the mounting end of the second housing being held spaced apart from the circuit board by the first electrical connector.

17. The dual connector assembly of claim 16, wherein the first mounting surface defines a datum surface for locating the second electrical connector relative to the first electrical connector independent of the circuit board.

18. The dual connector assembly of claim 16, wherein the mounting end of the second housing is positioned by the first electrical connector spaced apart from the circuit board.

19. The dual connector assembly of claim 16, wherein a gap is defined between the mounting end of the second housing and the circuit board.

20. An electrical connector system comprising:

a circuit board having a first surface and a second surface with an edge extending therebetween, the circuit board having first conductors at the first surface and second conductors at the second surface, the circuit board having a locating opening open between the first and second surfaces;

a first electrical connector coupled to the circuit board, the first electrical connector having a first housing holding a first contact electrically connected to the first conductor, the first housing having a mating end and a mounting end, the mating end configured to be mated with a first mating connector, the mounting end mounted to the circuit board, the first contact extending between the mating and mounting ends for electrical connection with the first mating connector and the circuit board, the first housing having a first mounting block including a first mounting surface; and a second electrical connector coupled to the circuit board, the second electrical connector having a second housing holding a second contact electrically connected to the second conductor, the second housing having a mating end and a mounting end, the mating end configured to be mated with a second mating connector, the mounting end being coupled to the mounting end of the first housing, the second contact extending between the mating and mounting ends for electrical connection with the second mating connector and the circuit board, the second housing having a second mounting block including a second mounting surface, the second mounting block facing the first mounting block at the mounting end such that the second mounting surface engages the first mounting surface to locate the second housing relative to the circuit board, the mounting end of the second housing being held spaced apart from the circuit board by the first electrical connector.

* * * * *